US005413097A

United States Patent [19]

Birenheide et al.

[11] Patent Number: 5,413,097

[45] **Date of Patent: * May 9, 1995**

[54] FAN-SUPPORTED GAS MASK AND BREATHING EQUIPMENT WITH ADJUSTABLE FAN OUTPUT

[75] Inventors: Torsten Birenheide, Krummesse; Torsten Lönneker-Lammers, Pogeez; Eckhard Riggert, Ovendorf, all of Germany

[73] Assignee: Drägerwerk AG, Lübeck, Germany

[ * ] Notice: The portion of the term of this patent subsequent to Apr. 19, 2011 has been disclaimed.

[21] Appl. No.: 7,483

[22] Filed: Jan. 22, 1993

[30] Foreign Application Priority Data

Jan. 25, 1992 [DE] Germany ..... 42 02 025.5

[51] Int. Cl.[6] ..... A62B 18/08; A62B 19/00; A62B 23/02

[52] U.S. Cl. ..... 128/206.17; 128/202.22; 128/205.23; 128/206.12

[58] Field of Search ..... 128/201.24, 201.25, 128/202.22, 202.27, 204.18, 205.12, 205.23, 205.25, 205.27, 205.28, 205.29, 206.12, 206.17

[56] References Cited

U.S. PATENT DOCUMENTS

| | | | |
|---|---|---|---|
| 3,496,703 | 2/1970 | MacLeod | 55/234 |
| 5,293,865 | 3/1994 | Altner et al. | 128/203.12 |
| 5,303,701 | 4/1994 | Heins et al. | 128/206.17 |

FOREIGN PATENT DOCUMENTS

| | | | |
|---|---|---|---|
| 2221164 | 1/1990 | United Kingdom | 128/201.25 |
| WO86/06643 | 11/1986 | WIPO . | |

*Primary Examiner*—Kimberly L. Asher
*Attorney, Agent, or Firm*—McGlew and Tuttle

[57] ABSTRACT

A fan-supported gas mask and breathing equipment with a fan unit with adjustable delivery output such that the delivery output of the fan and detection sensor will be automatically adjusted to the necessary filter property, depending on the type of the filter insert used. To achieve this, the filter connection (10) and the filter insert (16) are provided with a marking, which characterizes the filter property (particle filter or gas filter), on the one hand, and, on the other hand, actuates electric contacts for setting the necessary fan output and, if desired, for actuating a detection sensor.

10 Claims, 4 Drawing Sheets

FAN-SUPPORTED GAS MASK AND BREATHING EQUIPMENT WITH ADJUSTABLE FAN OUTPUT

BACKGROUND OF THE INVENTION

Such a gas mask has become known from WO 86/06643. According to this disclosure a fan aspirates surrounding air, which is purified by a suitable filter—particle or dust filter, or gas filter—and undesired harmful substances are thus removed. The filter is taken up in a filter housing, which also simultaneously contains the fan and the connections and actuation elements necessary for driving it. Depending on the filter used, different fan powers are required: a gas filter requires only a small flow, so that it will not be exhausted prematurely, and a particle filter requires a greater fan power due to its elevated flow resistance. One type of filter element is adapted to depress a switch so that the fan runs at one speed whereas the other type of filter element does not engage a switch such that the fan runs at the other speed.

Another gas mask has become known from U.S. Pat. No. 3,496,703 which consists essentially of a backpack-like gas processing unit, which is connected to a breathing mask connected to a protective helmet via a fan connection. The air to be inhaled is processed in the gas processing unit by first passing ambient air through various filters and humidifying it. The respiration air thus processed is fed to the user of the gas mask and breathing equipment via the respiration hose. The delivery of the ambient air through the filters, the humidifier, and the respiration hose to the user of the gas mask and breathing equipment is ensured by an electric fan, which can be operated optionally from an internal or external battery. If the external battery is used to supply the fan with energy, the fan output can be varied in two steps, namely, a fast fan step and a slow fan step.

It is disadvantageous in the prior-art gas mask and breathing equipment that the fan output can be changed only when an external source of energy is used to drive the fan, and that the fan output can be changed only manually. It happens in practice that, depending on the field of application and the working conditions, different filters must be inserted into the gas mask and breathing equipment. For example, particle filters are to be used if dust is released in the environment during work, or gas filters must be used if gaseous toxic substances can be expected to occur in the working area atmosphere. It may also happen that so-called combination filters must be used when both dust and gaseous toxic substances are to be suspected in the working environment.

Known gas masks can in fact be adapted with respect to their fan power to the respective filter utilized and their service lives thus permit operational times that are as long as possible, but the person who wears the device, now as well as before, is left in uncertainty with respect to whether the filter utilized can be inserted in a functionally safe manner or whether during use it has become nearly exhausted and cannot be inserted again. In many cases of gas filtering, a breakthrough of the filter is either not noticed or can only be noticed later. Thus, for example, odorless harmful gases generally may not be detected by the wearer of the device.

SUMMARY AND OBJECTS OF THE INVENTION

The primary object of the present invention is to improve a gas mask and breathing equipment of the type described such that the state of consumption is monitored as a function of the filter insert used.

This task is accomplished by the filter connection having a sensor identification or a connection marking (information element, identification element or coding) corresponding to the filter property of the filter insert, which marking activates a detection sensor that is sensitive to the harmful substance to be retained by the filter in the case of the filter insert used; the solution to the task can also be produced by having the filter connection open up into a pressure channel, which is derived from a pressure sensor.

Since the type of filter used influences the mode of operation of the gas mask with respect to the fun power, a filter property which is exhausted during long-time use of the filter can now be recognized as early as possible in order to improve the monitoring of the gas mask used and the filter performance.

Depending on the flow behind the filter, a measurement channel opening can be provided in the filter insert from which a measurement channel leads to the detection sensor for a gas sample. With excessive use of a filter, minimal quantities of the gaseous harmful material are passed through the filter, which are still not harmful to the wearer of the device, but which activate the more sensitive gas sensor to indicate a threatening filter breakthrough. For example, electrochemical gas sensors can come into play as the detection sensor, through which a current is produced in the presence of the gaseous harmful material, by means of which a warning or a indicator device signals the wearer of the device that a further utilization of the gas mask is no longer advisable and that he should thus withdraw from the region of danger. In this connection, a corresponding warning threshold can also be adjusted simultaneously by means of the identification, which threshold can be different for different gases, in the case of the respective detections sensors utilized. Electrochemical sensors may be differently sensitive to the different gases, so that a single sensor can detect several gases depending on the adjusted warning threshold. In the case of an incorrectly functioning inserted filter, leakages may occur, by which means harmful gas reaches the sensor, which indicates this situation and thus warns of it.

The electrical contacts or signals triggered by the identification can be further processed by means of an electronic circuit and can be programmed, e.g., by means of a microprocessor by the manufacturer such that an optimal equipping of the gas mask is provided by the software for the respective insert desired by the customer.

If a particle filter for retaining airborne particles with a smaller flow resistance or a gas filter with a higher flow resistance is utilized, either a smaller fan power or a higher fan power will be selected, by which the fan will be driven with a lower or a correspondingly higher rpm. If so-called combination filters are utilized, a flow resistance which is produced for this case will be correspondingly considered in the adjustment of the fan power. Even in fluctuating fields of use and with different types of filters, the wearer of the device can always depend on the fact that the fan power is in conformance with the necessary filter property.

If the filter housings are used as plug-in filters, it is advantageous to arrange the filter marking in the outer area of the filter insert, e.g., on the outer surface of he filter housing facing the filter connection. Thus, when the plug-in filter is attached to the filter connection, the filter marking will engage the connection marking, and actuate a corresponding electric contact, which will adjust the output of the fan to the value which is necessary for the necessary flow of ambient air through the particle filter.

Gas filters and combination filters are usually provided with a threaded connection, with which the filter insert must be screwed into the filter connection of the gas mask and breathing equipment. To provide such filters with threaded connection with a marking as well, without having to change the filters themselves, it is advantageous to provide a filter adapter, on the circumferential surface of which the filter marking is arranged and which can be attached to the filter connection. Thus, it is possible, on the one hand, to use the same filter connection as for the plug-in filters, because the marking has been transferred from the filter insert to the filter adapter, and, on the other hand, the filters with threaded connection do not need to be changed, and if the filter adapter is designed correspondingly, it will be possible to accommodate either a plug-in filter or a filter with threaded connection on the same filter connection.

Since the type of the filter used influences the mode of operation of the gas mask and breathing equipment in terms of the fan output, it is useful, for improving the monitoring of the gas mask and breathing equipment used and the filter output, to recognize a filter property that is exhausted in the course of prolonged use of the filter as early as possible. To achieve this, it is advantageous to provide in the filter connection a sensor marking which activates a detection sensor, which is sensitive to the toxic substance retained by the filter insert, when the filter insert or filter adapter is attached. A measuring pipe opening, from which a measuring pipe for a gas sample leads to the detection sensor, is to be provided in the filter insert downstream of the filter. During excessive use of a filter, very small amounts of the gaseous toxic substance pass through the filter, and these very small amounts, though harmless for the user of the device, activate the far more sensitive gas sensor to indicate a threatening filter breakthrough. The suitable detection sensors may be, e.g., electrochemical gas sensors, which generate a current in the presence of the gaseous toxic substance, and this current causes a warning or indication device to signal for the user of the device that further use of the gas mask and breathing equipment is no longer advisable, so that he should leave the hazardous area. A corresponding warning threshold can also be set in this connection, and this threshold may be different for different gases for the detection sensors used.

The electric contacts or signals brought about by the marking can be subjected to further processing by means of an electronic circuit and can be programmed by the manufacturer, e.g., by means of a microprocessor, such that the customer is able to provide the gas mask and breathing equipment with the necessary software for the desired use.

In an advantageous embodiment of the filter marking, the marking may be designed as pins of various geometric shapes, which are arranged on the filter insert or on the filter adapter, and extend into corresponding recesses of the filter connection. In the assembled state of the filter insert or filter adapter with the filter connection, electric contacts are closed to influence the driving power of the fan and, if desired, to activate the detection sensors.

Another possibility of implementing the necessary marking is to arrange magnetic surfaces, which actuate reed contacts arranged on the associated points of the filter connection, on the filter circumference or the adapter circumference according to a predeterminable pattern.

To be sure, for the filter or adapter used, whether mounting or insertion of the filter is guaranteed, a pressure sensor is mounted in the connection housing, and this pressure sensor extends from the housing with a pressure pipe opening and measures the vacuum generated during operation. If a filter is inserted properly, vacuum is generated on the suction side of the filter when the fan is switched on, and this vacuum is sensed by the pressure sensor and is processed via the electronic circuit (microprocessor). Depending on the type of filter used, which is communicated to the circuit by the marking, different vacuum thresholds can be preset, and if the actual pressure exceeds or is below these vacuum thresholds, it is indicated that no filter has been inserted at all, or that the filter does not fit tightly, or the filter is charged (e.g., with dust particles) to the extent that the necessary filter output can no longer be reached.

Both the pressure sensor and the gas sensor may be provided together, but the pressure sensor may also be mounted alone, in order to monitor at least the basic functions for reliable operation of the gas mask and breathing equipment.

A further improvement of the monitoring possibility is achieved by providing the filter housing on the outer surface facing the filter connection with a coding for the type of gas, which transmits the type of gas to be filtered, in coded form, to a decoder. The coding of the type of gas may consist of strip-like reflection surfaces, wherein the decoder has a corresponding number of light emitters (e.g., LEDs), which direct bundled radiation toward the reflection strips when the filter is inserted, and, depending on their geometric arrangement, these reflection strips reflect the reflected radiation to radiation detectors. The number and position of the detectors hit by the reflected rays provides information on the type of filter (particle filter or gas filter), and, in the case of gas filters, additionally also on the type of filter inserted (in terms of the gas to be retained), and this information is transmitted to the electronic circuit for evaluation. This evaluation consists of setting the fan output, on the one hand, and of activating the corresponding gas sensor or selecting the corresponding warning thresholds, on the other hand. If a pressure sensor is also additionally present on the screw-in filter, filter marking on the adapter may be omitted.

On the other hand, the marking on the adapter may be retained in this advantageous embodiment in order to send the information to the gas mask and breathing equipment indicating that a screw-type filter will now be attached, as a result of which only the electronic components for recognizing the type of gas will be activated, because these need not be activated by all means when a plug-in particle filter without intermediary of an adapter is to be accommodated by the filter connection.

The coding of the type of gas makes it possible to utilize such a comfortable marking even if the filter connection itself has a threaded holder, into which the screw-in filters, coded for the type of gas, can be screwed.

Instead of working with LEDs and reflection strips, it is also possible to provide, on the filter side, a number of annular, concentric elevations, which actuate corresponding microswitches on the side of the filter connection of the fan housing in the screwed-on state.

The gas type coding may be arranged on the filter housing regardless of whether the filter is a screw-type or plug-type filter.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
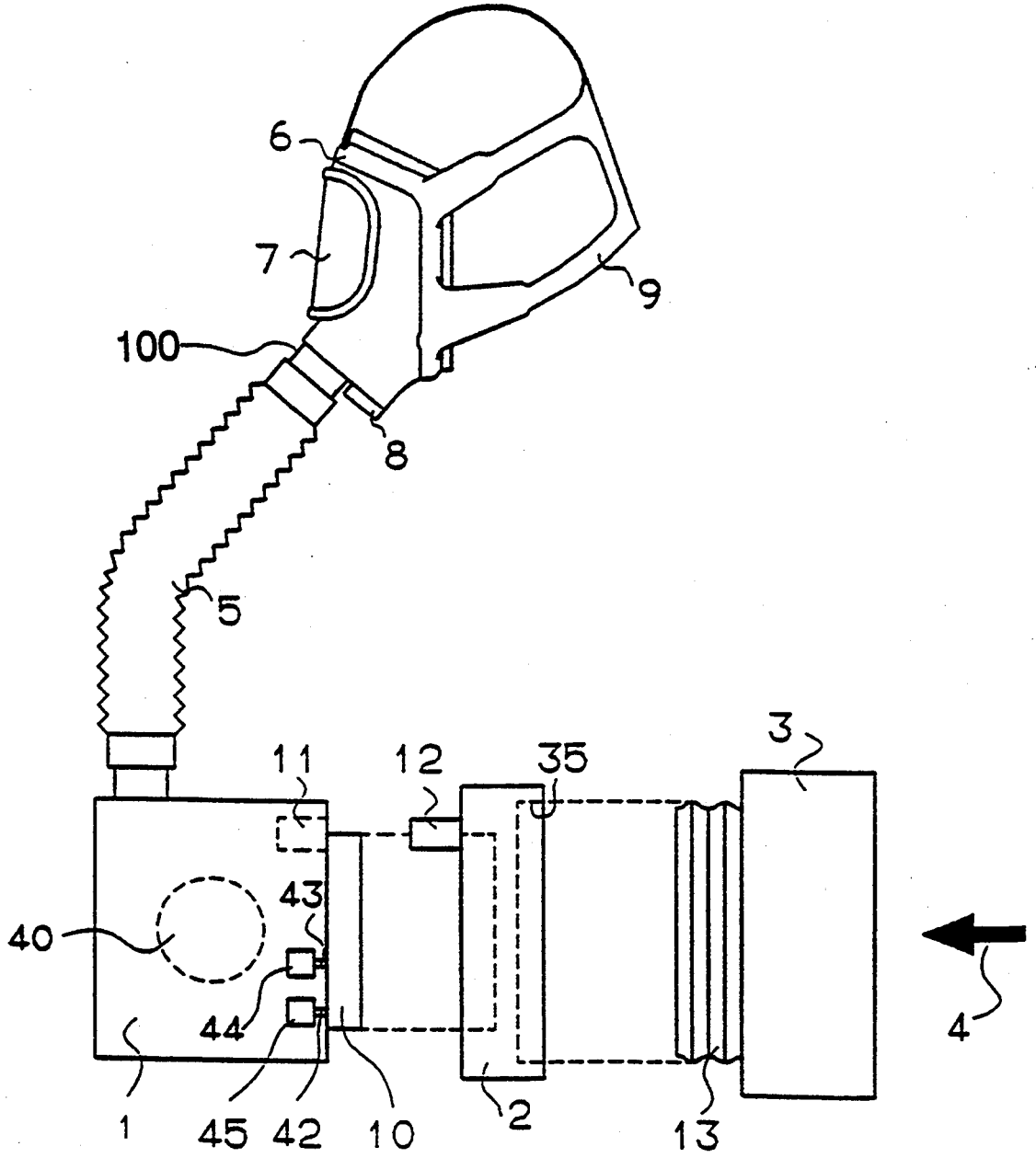
FIG. 1 is a schematic view of a gas mask and breathing equipment with fan, filter, and protective mask according to the invention.

FIG. 1 shows a fan-supported gas mask and breathing equipment, in which a filter adapter 2 and a gas filter 3 are connected, one behind the other on the suction side, to a fan housing 1. A fan drive 40, indicated by a circle drawn in broken line, delivers the ambient air according to the flow arrow 4 in the direction of an outlet-side respiration gas hose 5, through which the filtered ambient air is delivered via filtered air connection 100 into a breathing mask 6. The mask 6 has an eye-protective lens 7 and an exhalation valve 8, and can be tensioned over the head of a mask user, not shown, via a strap 9. The fan housing 1 has a filter connection 10 with a recess 11 serving as a connection marking or connection identification means, into which corresponding pin 12 forming filter identification means of the filter adapter 2, acting as filter marking, extends. The adapter 2 has, on the suction side, a threaded insert 35, into which a screw thread 13 of the gas filter 3 is screwed. The connection lines between the housing 1, the adapter 2, and the filter 3, which are drawn in broken line, indicate the movements which are necessary for assembly of the individual components shown.

Figure 2:
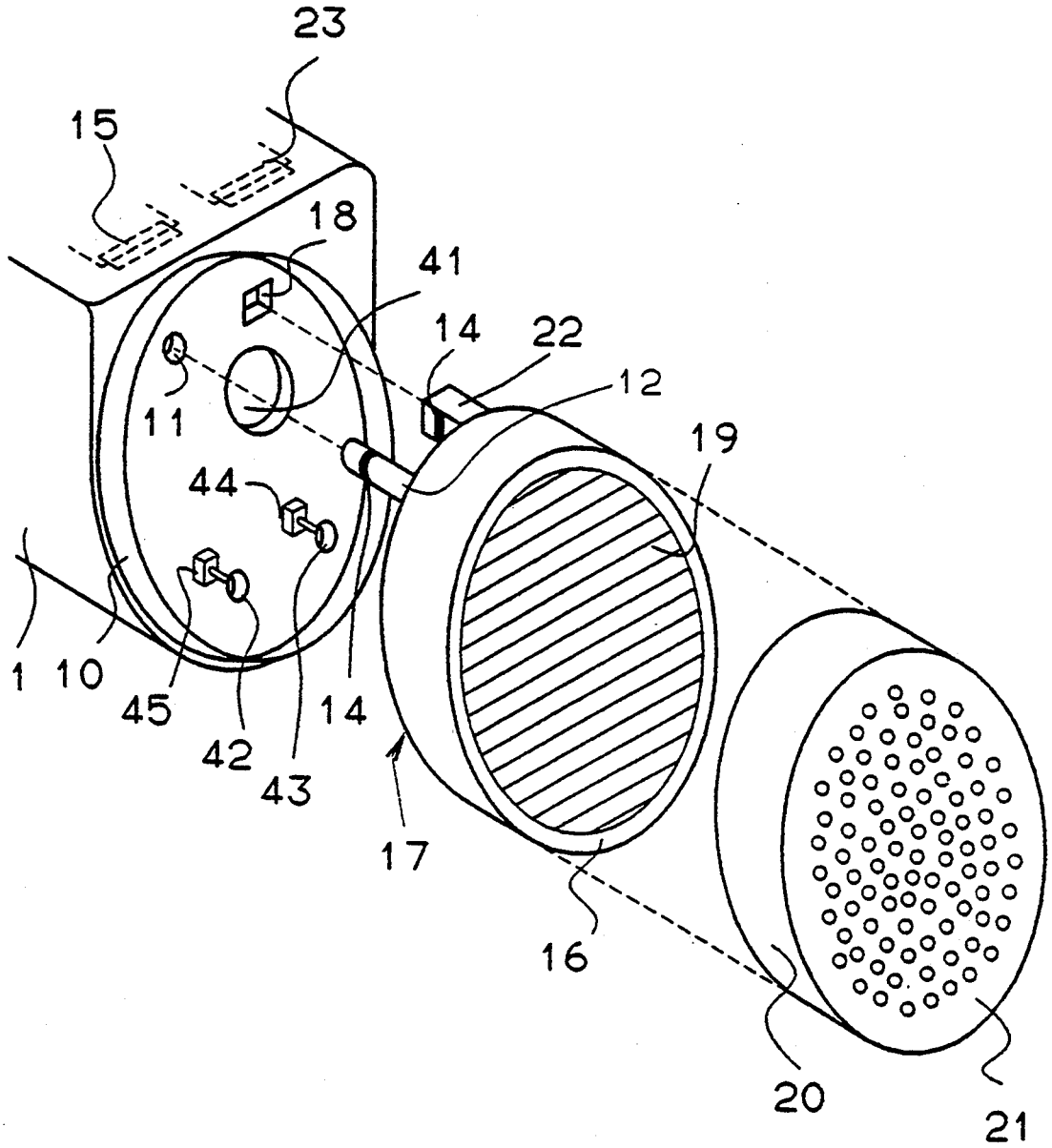
FIG. 2 is a schematic perspective representation of a filter connection with a filter insert and the associated marking according to the invention.

FIG. 2 shows schematically the filter housing 1, and it shows a perspective view of the filter connection 10 with an inlet opening 41 for the filtered respiration gas to be delivered from the environment. The housing 1 has the recess, designed as the connection identification means 11, into which the corresponding filter marking or filter identification means 12, designed as a round pin, extends. The filter marking 12 is provided with a magnetic strip 14, which actuates an electric contact accommodated in the housing 1, e.g., a reed contact 15, when the markings 11, 12 engage each other. Due to the closing of the contact 15, the fan output necessary for flow through the filter insert 16 is set in a microprocessor, not shown, which is accommodated in the fan housing 1. On its housing surface 17 facing the inlet opening 41, the filter insert 16 carries the filter marking, which in turn consists of the round pin 12 provided with the magnetic strip 14, on the one hand, and, on the other hand, a square pin 22, the latter of which is received in a corresponding recess acting as a sensor marking 18 in the fan housing 1. The recess 18 and the square pin 22 together provide sensor identification means providing information from the filter insert 16 as to what is to be detected by sensor 44. The pin 22 forms an information source element and the sensor marking 18 forms an information receiving element upon engagement with the pin 22. The square pin 22 is provided with the magnetic strip 14 (as the information source), which actuates, in the inserted state (inserted into sensor marking 18), an electric reed contact 23, represented by broken line, as a result of which a detection sensor 44 belonging to the filter insert 16 will be actuated. The sensor marking 18 with the corresponding detection sensor 44 is adjusted to the filter material 19 contained in the filter insert 16. A measuring pipe opening 43 and a pressure pipe opening or pressure channel 42, which lead to the gas sensor 44 or a pressure sensor 45, respectively, are also arranged in the filter connection 10. A filter cover 20, which is provided with a perforation 21 on the suction side, is placed over the filter insert 16. The cover 20 serves to mechanically protect the filter insert 16.

Figure 3:
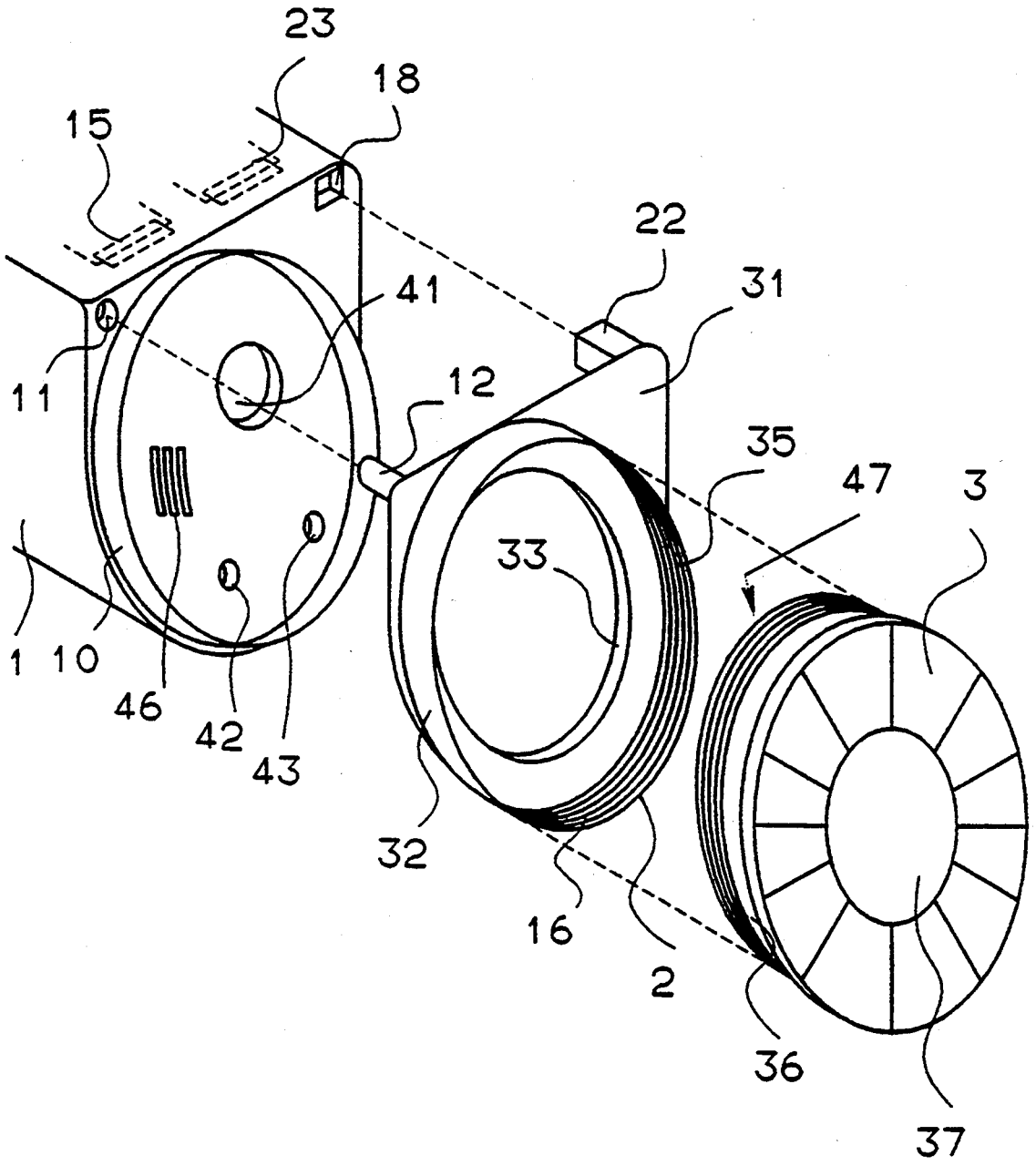
FIG. 3 is a schematic perspective representation of the filter connection with a filter adapter located in front of the gas filter according to the invention.

FIG. 3 shows the same the fan housing 1 as does FIG. 2, which contains the filter adapter 2, which also carries the filter marking 12, 22 on corresponding flaps 31, in its circumferential area 32. The adapter 2 is provided with a flow opening 33, through which the ambient air, purified in the gas filter 3, flows into the inlet opening 41 of the fan housing 1. The filter adapter 2 also has a threaded insert 35 for screwing in the gas filter 3 with its screw thread 36. The gas filter 3 has a filter opening 37 toward the atmosphere.

Figure 4:
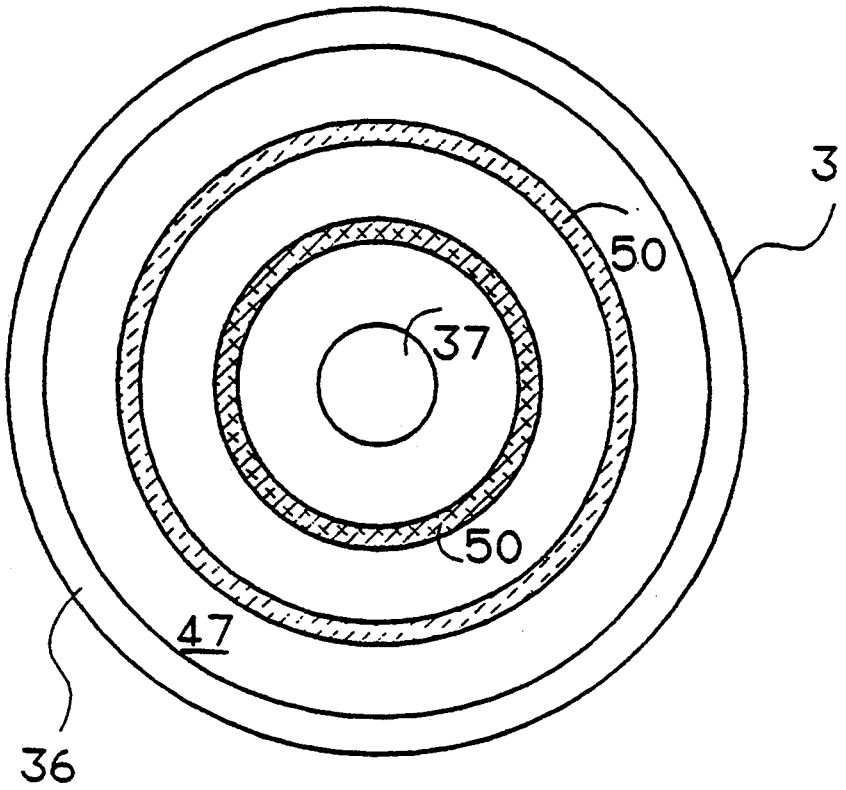
FIG. 4 is a schematic view of the screw-type filter with the gas type marking.

The surface of the fan housing at the filter connection 10, facing the adapter 2 and the gas filter 3, carries three reflection photocells 46, which are arranged next to each other and consist each of an LED as a light source and a photodetector acting as a receiver. This structure provides a gas type decoder which is a further part of the sensor identification means. The LEDs emit light to reflection strips 50, which are arranged concentrically on the end face 47 of the gas fan housing at the filter 3 facing the filter connection 10, as is shown in FIG. 4. The reflection strips 50 form the gas type coding for the further part of the sensor identification means.

The number and position of the strips 50 may be combined corresponding to the type of gas for which the filter 3 is suitable, so that corresponding reflected rays will hit the detectors 46, and generate an electric signal in them. The information on the gas filter 3 used, thus coded, is sent to the electronic circuit accommodated in the fan housing 1, so that the necessary fan output will be set, on the one hand, and, on the other hand, threshold values are established, which are important for the gas sensor 44 for sending a warning signal when it measures a gas concentration exceeding the threshold value, which warns of an imminent filter breakthrough.

The view of the screw-in filter 3 according to FIG. 4 shows its end face 47 which faces the filter connection 10 and is interrupted by the filter opening 37 and is surrounded by the screw thread 36. The end face 47 carries two the reflection strips 50, the distance between which corresponds to the distance between the two outer LED/detector combinations 46; these emit their light onto the strips 50, and receive a correspondingly reflected signal. The central one of the LED/detector combinations 46 receives no reflected signal.

While a specific embodiment of the invention has been shown and described in detail to illustrate the application of the principles of the invention, it will be understood that the invention may be embodied otherwise without departing from such principles.

What is claimed is:

1. Breathing equipment, comprising:

a protective mask including a filtered air connection;

an electrically driven fan with adjustable driving power, said fan being positioned in a fan housing, said fan being connected to said protective mask via said filtered air connection;

a filter connection associated with said fan housing for attaching a filter insert with different filter properties, said fan housing including a connection identification means, positioned adjacent said filter connection for receiving filter property information;

a filter insert including filter identification means for providing filter property information, said filter identification means being forced into engagement with said connection identification means upon attaching said filter insert to said filter connection;

at least one electric contact being actuated by said connection identification means upon engagement with said filter identification means to adjust delivery output of said electrically driven fan to the filter property assigned to the attached filter insert;

sensor identification means including an information source element on said filter insert and an information receiving element on said fan housing adjacent said filter connection, said sensor identification means receiving information as to harmful material to be sensed for activating a detection sensor, which is sensitive to the harmful material retained by the filter for the filter insert introduced.

2. Breathing equipment according to claim 1, wherein:

said filter identification means is arranged in a circumferential area of said filter insert, said filter insert including a filter adapter provided for attachment to said filter connection, said filter adapter including means for receiving a screw-type filter.

3. Breathing equipment according to claim 1, wherein:

said filter identification means comprises a pin having a geometric shape, said information source element comprising a pin having a geometric shape which is different from said filter identification means pin.

4. Breathing equipment according to claim 1, wherein:

said filter insert includes an end face facing said fan housing at said filter connection, said end face carrying a gas type coding which is brought into functional connection with a decoder provided on said fan housing adjacent said filter connection, said gas type coding and said decoder forming a further part of said sensor identification means.

5. Breathing equipment according to claim 4, wherein:

said gas type coding is formed of a predeterminable number of concentric reflection strips, said decoder being formed of a plurality of light emitter/-light detector elements.

6. Breathing equipment, comprising:

a protective mask including a filtered air connection;

an electrically driven fan with adjustable driving power, said fan being positioned in a fan housing, said fan being connected to said protective mask via said filtered air connection;

a filter connection associated with said housing for attaching a filter insert with different filter properties, said fan housing including a connection identification means, positioned adjacent said filter connection for receiving filter property information;

a filter insert including filter identification means for providing filter property information, said filter identification means being forced into engagement with said connection identification means upon attaching said filter insert to said filter connection;

at least one electric contact being actuated by said connection identification means upon engagement with said filter identification means to adjust delivery output of said electrically driven fan to the filter property assigned to the attached filter insert;

a pressure channel formed in said fan housing at said filter connection;

a pressure sensor connected to said pressure channel for sensing the pressure at said pressure connection and sensor identification means including an information source element on said filter insert and an information receiving element on said fan housing adjacent said filter connection, said sensor identification means receiving information as to harmful material to be sensed for activating a detection sensor, which is sensitive to the harmful material retained by the filter for the filter insert introduced.

7. Breathing equipment according to claim 6, wherein:

said filter identification means is arranged in a circumferential area of said filter insert, said filter insert including a filter adapter provided for attachment to said filter connection, said filter adapter including means for receiving a screw-type filter.

8. Breathing equipment according to claim 6, wherein:

said filter identification means comprises a pin having a geometric shape, said information source element comprising a pin having a geometric shape which is different from said filter identification means pin.

9. Breathing equipment according to claim 6, wherein:

said filter insert includes an end face facing said fan housing at said filter connection, said end face carrying a gas type coding which is brought into functional connection with a decoder provided on said fan housing adjacent said filter connection, said gas type coding and said decoder forming a further part of said sensor identification means.

10. Breathing equipment according to claim 9, wherein:

said gas type coding is formed of a predeterminable number of concentric reflection strips, said decoder being formed of a plurality of light emitter/-light detector elements.

* * * * *